US009630080B1

(12) United States Patent
Lanyi

(10) Patent No.: US 9,630,080 B1
(45) Date of Patent: Apr. 25, 2017

(54) PUTTER ALIGNMENT APPARATUS

(71) Applicant: William A. Lanyi, Beaufort, SC (US)

(72) Inventor: William A. Lanyi, Beaufort, SC (US)

( * ) Notice: Subject to any disclaimer, the term of this patent is extended or adjusted under 35 U.S.C. 154(b) by 0 days.

(21) Appl. No.: 15/192,043

(22) Filed: Jun. 24, 2016

(51) Int. Cl.
*A63B 69/36* (2006.01)
*A63B 53/04* (2015.01)
*A63B 53/06* (2015.01)

(52) U.S. Cl.
CPC ..... *A63B 69/3685* (2013.01); *A63B 53/0487* (2013.01); *A63B 2053/0416* (2013.01); *A63B 2053/0441* (2013.01); *A63B 2053/0462* (2013.01); *A63B 2053/0491* (2013.01)

(58) Field of Classification Search
CPC ..... A63B 69/3685; A63B 53/007; A63B 53/0487; A63B 2053/0462; A63B 2053/0416; A63B 2053/0441; A63B 2053/0491
USPC ..... 473/334–339, 244–248, 251–256, 330, 473/340, 341, 236
See application file for complete search history.

(56) References Cited

U.S. PATENT DOCUMENTS 656,099 A * 8/1900 Dunn ..... A63B 53/0487 473/330
1,901,562 A * 3/1933 Main ..... A63B 53/04 473/330
2,155,830 A * 4/1939 Howard ..... A63B 53/06 473/246
2,472,312 A * 6/1949 Parrish ..... A63B 53/0487 473/330
2,652,256 A * 9/1953 Thomas ..... A63B 53/08 473/333
2,932,515 A * 4/1960 May ..... A63B 53/065 473/248
3,220,733 A * 11/1965 Saleeby ..... A63B 53/0487 473/335
3,333,854 A * 8/1967 White ..... A63B 53/0487 473/249
3,489,415 A * 1/1970 Smith ..... A63B 69/3685 473/236
3,909,005 A * 9/1975 Piszel ..... A63B 53/007 473/248
3,917,277 A * 11/1975 Beck ..... A63B 69/3685 473/244
3,989,257 A * 11/1976 Barr ..... A63B 53/0487 473/251
4,195,842 A * 4/1980 Coleman ..... A63B 53/04 29/415
4,736,951 A * 4/1988 Grant ..... A63B 53/06 473/246
5,230,509 A * 7/1993 Chavez ..... A63B 53/0487 473/334

(Continued)

*Primary Examiner* — Sebastiano Passaniti
(74) *Attorney, Agent, or Firm* — Lawrence J. Gibney; Mitchell Ghaneie

(57) ABSTRACT

Putting in the game of golf is an acquired art but one that must be perfected for the golfer, whether amateur or professional must master in order to be successful. A modified putter that incorporates the use of a striking surface that extends away from the face of the putter and is slightly curved with a counterweight and a slot in the face of club is contemplated. Other embodiments use the same striking surface that is affixed to the face of the putter and the use of a counterweight have also been contemplated.

2 Claims, 4 Drawing Sheets

(56) References Cited

U.S. PATENT DOCUMENTS 5,382,019 A * 1/1995 Sneed ..... A63B 53/02 473/304
5,429,356 A * 7/1995 Dingle ..... A63B 53/02 473/251
5,597,364 A * 1/1997 Thompson ..... A63B 53/0487 473/314
5,769,737 A * 6/1998 Holladay ..... A63B 53/065 473/336
5,924,938 A * 7/1999 Hines ..... A63B 53/02 473/307
6,001,024 A * 12/1999 Van Alen, II ..... A63B 53/02 473/244
6,019,686 A * 2/2000 Gray ..... A63B 53/0487 473/313
6,179,727 B1 * 1/2001 Giordano ..... A63B 53/0487 473/330
6,203,444 B1 * 3/2001 McRae ..... A63B 53/0487 473/244
6,379,264 B1 * 4/2002 Forzano ..... A63B 53/065 473/336
6,464,596 B1 10/2002 Belding
6,511,387 B2 * 1/2003 Grieb ..... A63B 53/0487 473/330
6,638,181 B1 * 10/2003 Norman, III ..... A63B 53/0487 473/330
6,776,727 B1 * 8/2004 Engdahl ..... A63B 53/0487 473/325
6,780,119 B1 8/2004 Gankas
6,821,212 B2 * 11/2004 Fowler ..... A63B 69/3632 473/236
6,951,517 B2 * 10/2005 Lindsay ..... A63B 53/02 473/313
6,988,956 B2 * 1/2006 Cover ..... A63B 53/065 473/244
7,041,004 B2 * 5/2006 Engdahl ..... A63B 53/007 473/295
7,824,276 B2 * 11/2010 Simpson ..... A63B 69/3623 473/226
8,206,234 B1 * 6/2012 Slater ..... A63B 53/0487 473/244
9,302,169 B2 4/2016 Lee
2008/0146372 A1 * 6/2008 John ..... A63B 53/007 473/341

* cited by examiner

PUTTER ALIGNMENT APPARATUS

BACKGROUND OF THE INVENTION

A. Field of the Invention

This device is a putter alignment apparatus or a modified golf putter to aid a golfer in perfecting the art of putting. Golf putters are used frequently for very short distances usually as the golfer is trying to place the ball in the hole. The putter has a flat surface for the face of the club and a shaft by which the golfer controls the movement of the club. In order to be a successful golfer it is important to perfect the art of putting. One of the challenges for putting in general is to insure that the ball strikes the flat surface of the golf club in the correct spot to maximize the accuracy of the shot.

With putting in general it is important to strike the ball so that the ball rolls along the green as opposed to being pushed for a distance on the green. If the ball is rolled, it is much easier to control the direction and speed of the ball therefore making the shot more predictable.

The art of putting, unlike other golf shots, requires a great deal of finesse or touch in order for the person to be successful.

B. Prior Art

There are other prior art references to putters in general and golf clubs.

A representative example of the prior art can be found at Belding, U.S. Pat. No. 6,464,596, which is a golf club alignment attachment. Other examples that can be found in the prior art include Lee U.S. Pat. No. 9,302,169 which is a golf putter practice device. In the Lee reference a separate attachment is placed on a golf club surface to train the golfer to strike the ball in the most advantageous place. Another reference can be found at Williams U.S. Pat. No. 5,441,270 which is straight hitting aide for golfers. This does not necessarily relate to putting but it relates to the alignment of golf shots in general.

BRIEF SUMMARY OF THE INVENTION

This is a modified golf putter. While many putters have different shapes, the putter is used by the golfer to direct the golf ball over very short distances. All putters have a shaft that is connected to a flat surface that is used to strike the ball. A flat surface allows the golfer to better control the movement of the ball. In order to achieve maximum success in the game of golf, the golfer must learn to control the direction of the ball after it is struck.

With this application several embodiments are described.

On the first embodiment a slot has been incorporated into the flat surface of the putter. A threaded member is inserted through the slot. On one end of the threaded member a striking surface has been placed. On the opposite end a counterweight has been placed. In order to insure that the counterweight remains in position a nut is then provided. Other objects may alternatively be used to secure the counterweight to the threaded member as well.

The striking surface will be slightly rounded towards the bottom portion of the surface in order to create a shot where the ball rolls towards the hole as opposed to being pushed towards the hole.

The counterweight is added to the opposite side of the threaded member to maintain the putter's balance and also to train the golfer in the most appropriate mechanics.

In this embodiment, the striking surface can be moved from side to side within the slot in order to aid a specific golfer in perfecting his or her putting.

In other alternative embodiments the counterweight can be affixed to the side of the putter, either evenly distributed on both sides of the putter or secured to one side of the putter. In both the alternative embodiments the striking surface is permanently affixed to the putter face.

NUMBERING DESCRIPTION

Figure 1:
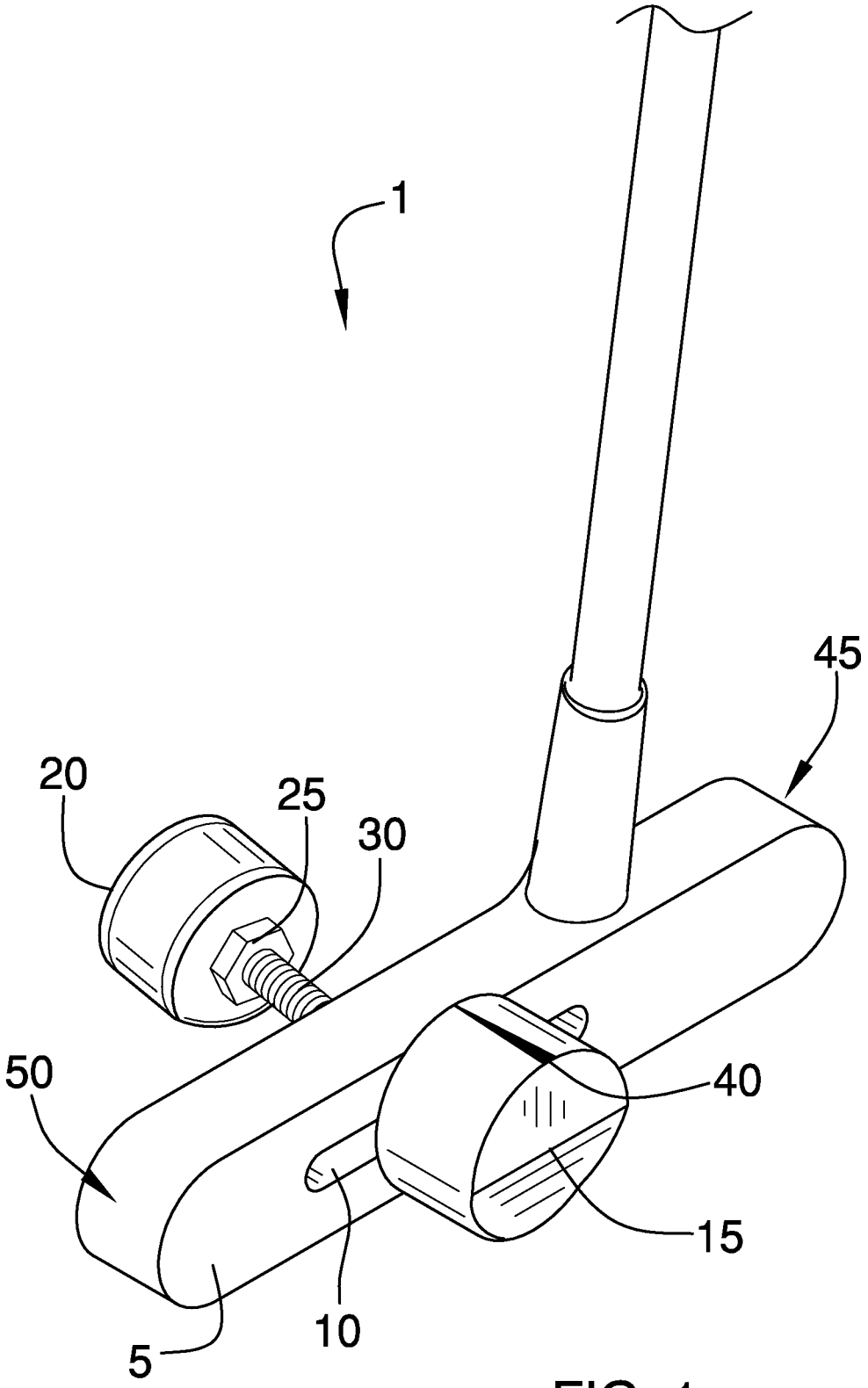
FIG. 1 is a front isometric view of the device.
Figure 2:
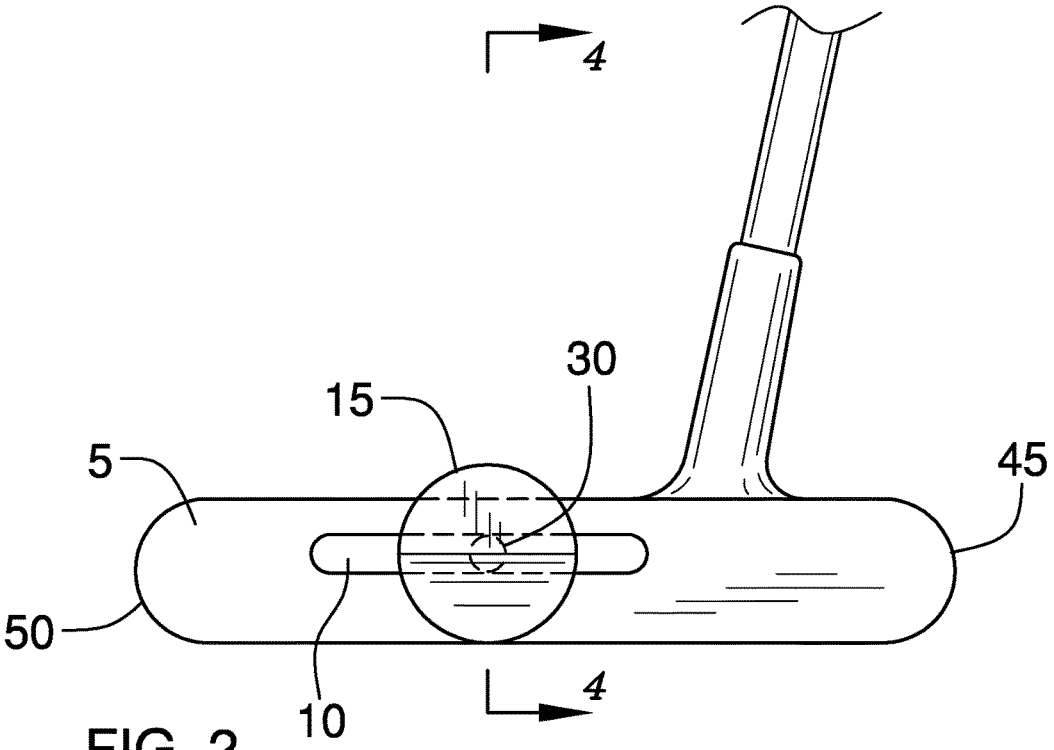
FIG. 2 is a front view of the device.
Figure 3:
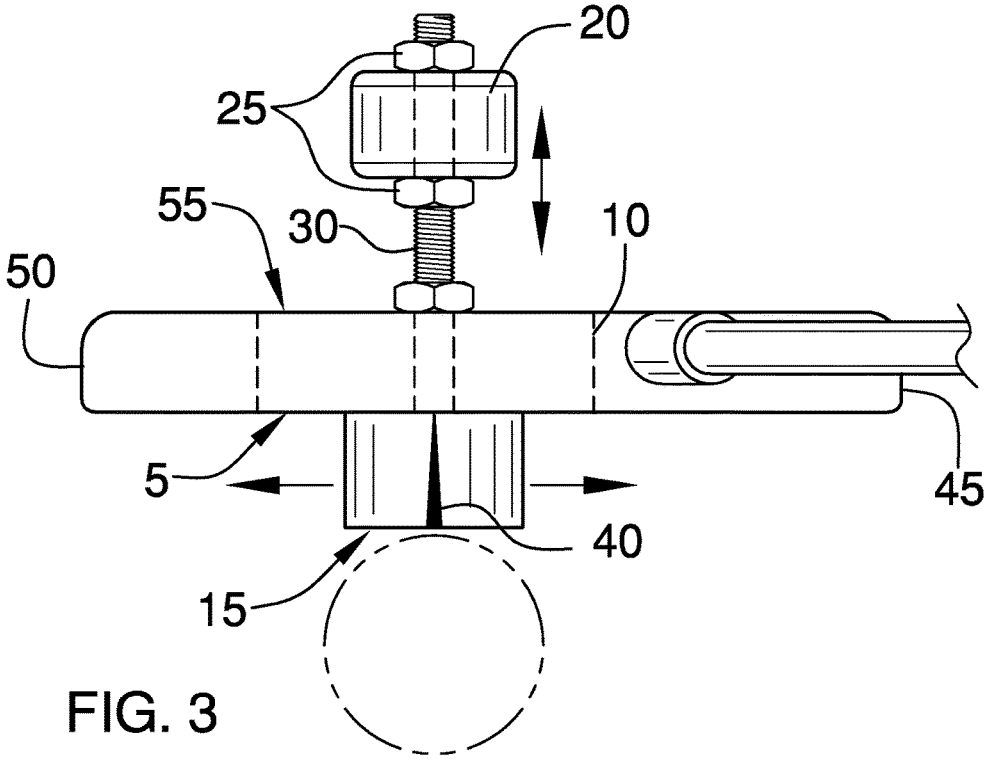
FIG. 3 is a top view of the device.

1 Putter
5 Face of putter
10 Slot
15 Strike surface
20 Counterweight
25 Means to secure
30 Threaded member
40 Alignment Marker

DETAILED DESCRIPTION OF THE EMBODIMENTS

This is a modified golf putter 1 or putter alignment apparatus. The golf putter face 5 is connected to a golf shaft. The golfer grips the shaft and controls the movement of the putter before striking the golf ball. On the face of the club a slot 10 will be provided to position a strike surface 15 on one side of the slot and a counterweight 20 on the other side of the slot. The strike surface 15 and counterweight 20 are connected to each other with a threaded member 30, likely a bolt, and secured in place with a nut 25, which could also be another device or object that secures the counterweight. Although no specific means to secure is being claimed, a nut is a likely choice.

Figure 4:
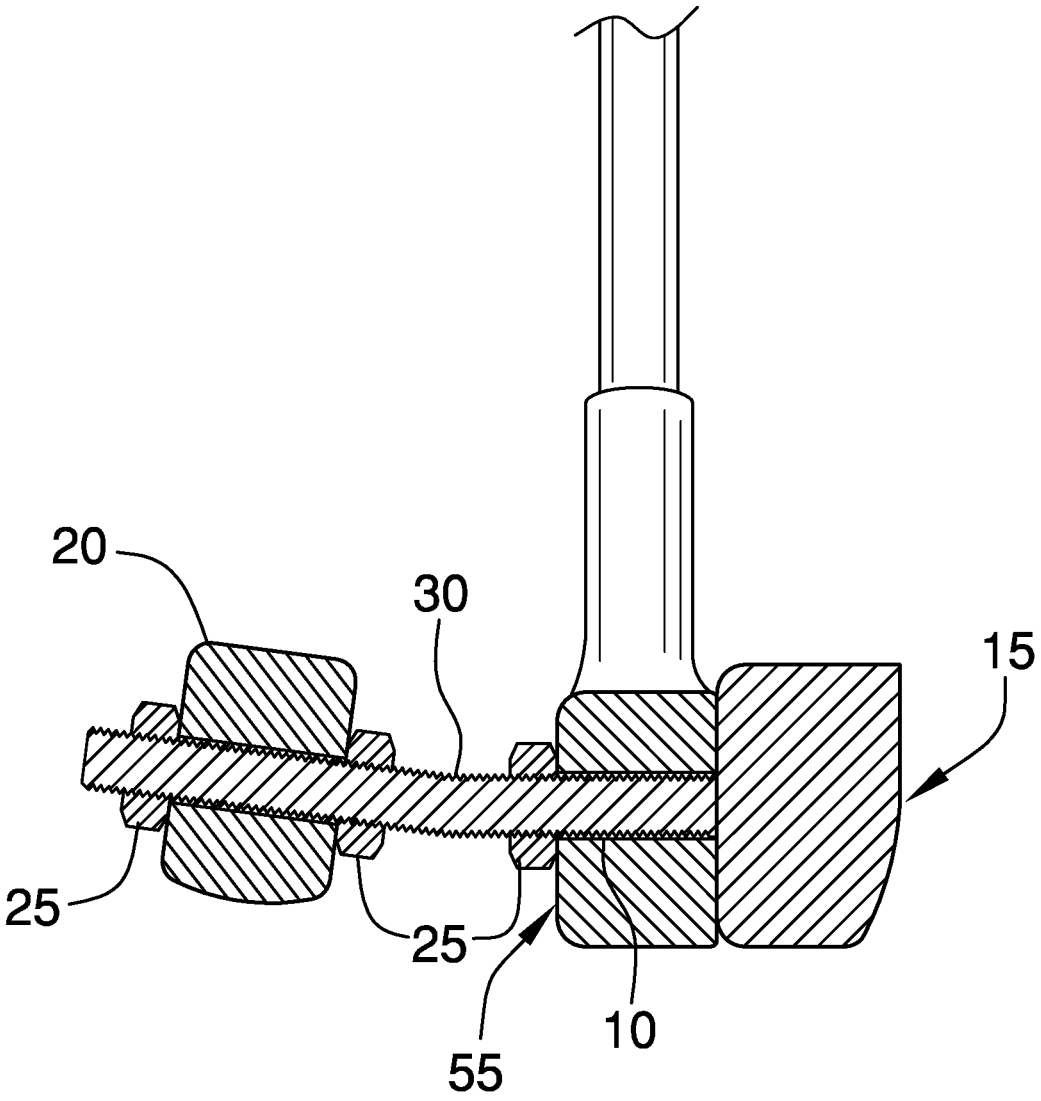
FIG. 4 is a cross-sectional view of the device.

The threaded member 30 is slightly curved upward as depicted in FIG. 4 to avoid the counterweight from accidently striking the playing surface during putting and distorting the shot.

The strike surface 15 on the front of the face of the putter will be flat but then will slightly curve downward at the point where the ball will strike the surface as depicted in FIG. 4; this particular design will force the ball to rotate immediately after it is struck as opposed to being pushed by the golf club. The immediate roll of the ball will enable the golfer to better control the speed and direction of the shot, thereby improving performance of the golfer.

The counterweight 20 that is positioned adjacent to the second side of the putter and connected to the strike surface can be moved away from the back of the putter. This movement of the counterweight and the striking surface will enable the user of the club to train the golfer in the proper mechanics of golfing to improve the golfer's game and allow the golfer the appropriate feel or "touch" of the putter.

Because everyone putts differently, the strike surface 15 and the counterweight 20 can be moved within the slot 10 from side to side to customize the device to the particular golfer to produce the most accurate shot.

Additionally, an alignment marker 40 will be incorporated into the strike surface to allow the golfer to attempt to strike the center of the golf ball using this alignment marker.

Second Embodiment

Figure 5:
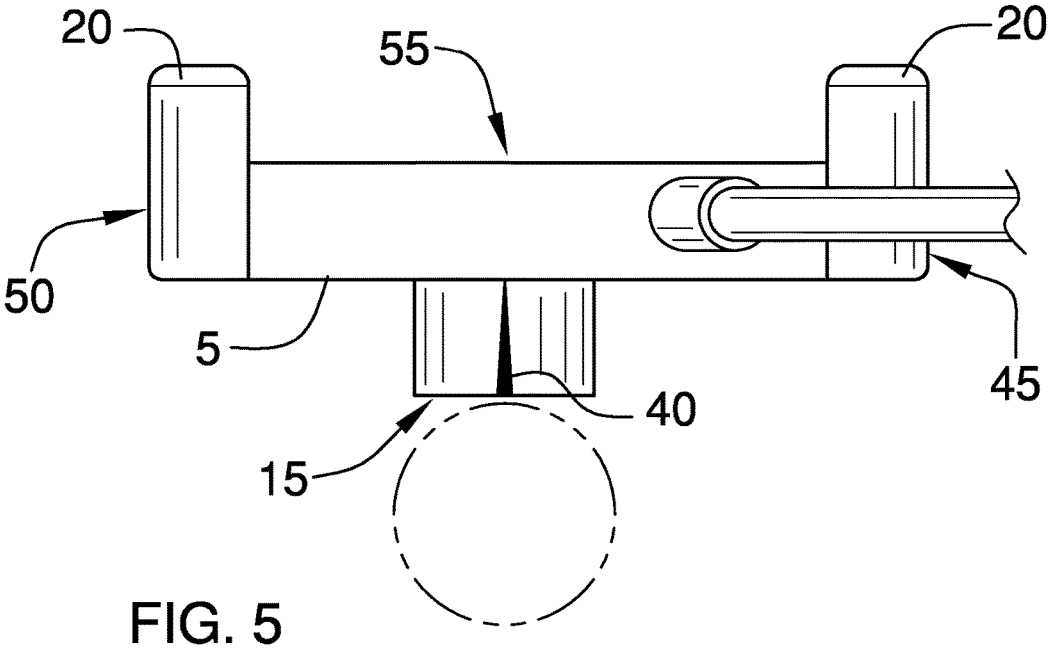
FIG. 5 is a depiction of an alternative embodiment with the counterweight attached to both sides of the putter.

In this second embodiment that is depicted in FIG. 5, the counterweight is evenly distributed on the face of the putter. The counterweight will not be allowed to move and the strike surface on the front of the putter is permanently affixed to the front of the club. The alignment marker is also used to assist the golfer in terms of lining up the shot for best control and mechanics.

Third Embodiment

Figure 6:
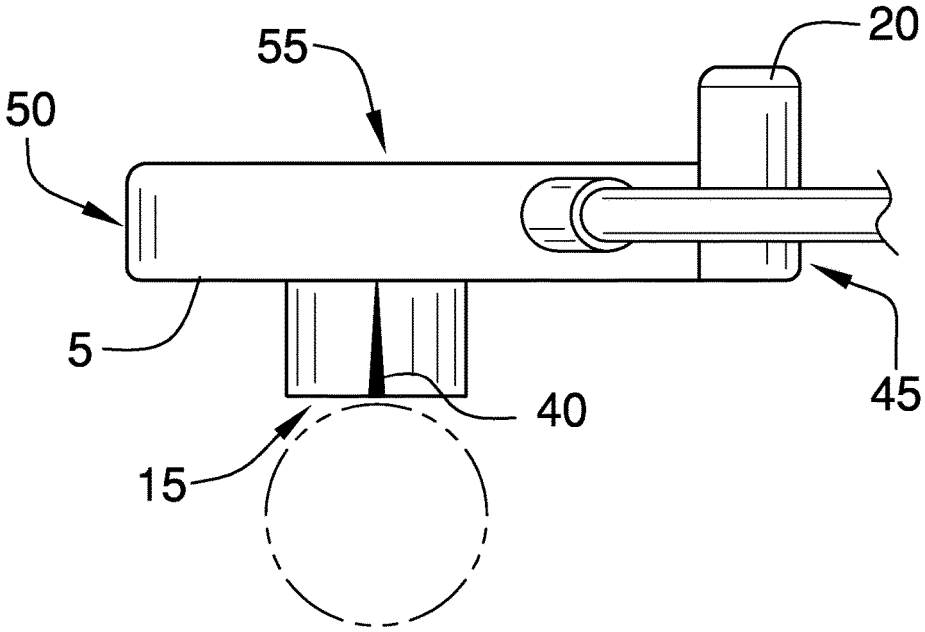
FIG. 6 is a depiction of an alternative embodiment with the counterweight attached to the side of the putter closest to the user of the device.

The third embodiment is depicted in FIG. 6 and is a variation of the second embodiment. The only difference between the second and third embodiments is the placement of the counterweight completely on one side of the face of the putter. In FIG. 6 the counterweight is placed on the side of the putter that is closest or proximate to the golfer. Although FIG. 6 depicts the counterweight on the side that is closest to the golfer, the counterweight may also be placed on the side of the putter away from the golfer.

The invention claimed is:

1. A putter which is comprised of:

a. a face;

wherein the face is of a predetermined configuration;

wherein the face is connected to a shaft of a golf club;

wherein the face includes a strike surface;

wherein the strike surface is of a predetermined shape;

wherein the strike surface abuts the surface of the face of the putter;

wherein a portion of the strike surface is curved;

b. a heel;

c. a toe;

d. a back surface;

wherein the back surface is located opposite of the face;

e. a slot;

wherein the slot is placed on the face and the back surface of the putter;

wherein the slot is of a predetermined shape;

wherein the slot permits movement of the strike surface from side to side within the slot;

f. an alignment marker;

wherein the alignment marker is provided on the strike surface;

g. a counterweight;

wherein the counterweight has a predetermined shape;

wherein the counterweight is placed adjacent to the back surface of the putter;

h. a threaded member;

wherein the strike surface and the counterweight are connected to each other on the threaded member;

wherein the threaded member is slightly curved upward when the putter is placed on a ground plane at address and viewed from the toe or the heel;

i. a means to secure the counterweight and the strike surface to the threaded member.

2. The putter as described in claim 1 wherein the strike surface begins to curve at a center of the strike surface.

* * * * *